US006368457B1

(12) United States Patent
Kraus et al.

(10) Patent No.: US 6,368,457 B1
(45) Date of Patent: Apr. 9, 2002

(54) INTERNAL PAPER SIZING AGENT

(75) Inventors: Bernard A. Kraus, Lexington; Frank DeStefano, Jr., Roanoke, both of VA (US); Gerald Katz, Charleston, SC (US)

(73) Assignee: Westvaco Corporation, New York, NY (US)

( * ) Notice: Subject to any disclaimer, the term of this patent is extended or adjusted under 35 U.S.C. 154(b) by 0 days.

(21) Appl. No.: 09/329,842

(22) Filed: Jun. 11, 1999

Related U.S. Application Data

(63) Continuation-in-part of application No. 09/087,879, filed on Jun. 1, 1998, now abandoned.
(60) Provisional application No. 60/054,733, filed on Aug. 5, 1997.

(51) Int. Cl.[7] ..... D21H 17/62
(52) U.S. Cl. ..... 162/180; 106/218; 106/238
(58) Field of Search ..... 162/180, 183; 106/218, 238

(56) References Cited

U.S. PATENT DOCUMENTS 4,333,795 A * 6/1982 Street ..... 162/180
5,192,363 A * 3/1993 Bussel et al. ..... 162/180

OTHER PUBLICATIONS

Strazdins, "Chemistry of rosin sizing", Tappi, vol. 64, No. 1(Jan. 1981), pp. 31–34.*

Casey, Pulp and Paper, 3rd ed. (1981) vol. III, Wiley–Interscience pp 1559, 1560.*

* cited by examiner

*Primary Examiner*—Peter Chin
(74) *Attorney, Agent, or Firm*—Terry B. McDaniel; Daniel B. Reece, IV; Richard L. Schmalz

(57) ABSTRACT

The present invention comprises an alum/rosin composition for internally sizing paper which is useful in any papermaking furnish with moderate to high hardness, as well as methods for preparing such alum/rosin composition. Employing the invention alum/rosin composition of an alum to rosin ratio of 1–3:1, respectively, and of a mean particle diameter of no greater than 10 microns, results in sizing of improved efficiency. In the preparation of the invention sizing composition, the pre-reacting of either neat or solutions of alum and rosin before introducing the mixture into the papermaking furnish, allows the alum to be free to react with the rosin size without any competition from other cations in the furnish.

15 Claims, 4 Drawing Sheets

INTERNAL PAPER SIZING AGENT

The instant application is a continuation-in-part application of commonly owned application Ser. No. 09/087,879 for "Method for Internal Sizing of Paper," filed on Jun. 1, 1998, now abandoned, which in turn is based on provisional application Ser. No. 60/054,733, filed on Aug. 5, 1997.

BACKGROUND OF THE INVENTION

1. Field of the Invention

The present invention relates generally to paper size used in the manufacture of paper and, more particularly, to size used in the manufacture of sized paper wherein the fibrous furnish used to make the paper has high hardness (i. e., an excess of calcium or magnesium ions). The present invention further relates to the method of production of such paper size.

2. Description of the Related Art (Including Information Disclosed Under 37 CFR 1.97 and 37 CFR 1.98)

The sizing of paper is an old and well-established art, and a wide variety of materials have been proposed heretofore for this purpose. Sizing agents are typically added to cellulose fibers to impart resistance of the paper to the penetration of liquids. Resistance to liquid penetration is necessary to prevent the paper from breaking down when the paper is exposed to water during the papermaking operation, e.g., passing through a size press starch solution prior to drying. Resistance to liquid is also necessary so that the print quality can be maintained upon application of water-based inks to the paper surface. As is well known, the sizing agent may be applied to the fibers during the papermaking operation, in which case the process is called internal sizing (also known as beater or engine sizing), or it may be applied to the surface of the paper after web formation, in which case it is called external or surface sizing. Internal sizing serves primarily to increase resistance to water penetration; whereas external sizing does that as well as improve other surface properties, such as strength or printability. Certain papers, such as those used in aseptic packaging may be produced via a two step sizing process comprising an internal size step and a surface size step, as is taught in U.S. Pat. No. 5,308,441 to Kern.

The sizing agents used in the paper industry cover a wide range of materials, including rosin size (such as aluminum salts of abietic acid), synthetic resins, glue or gelatin (animal-derived) starch or cellulose derivatives, lattices, polyvinyl alcohol, wax emulsions, and many other similar materials. Some of these such as rosin size, are used exclusively as internal sizing agents, while others, such as polyvinyl alcohol, are used almost entirely as surface sizing agents. Some materials, such as wax, may be applied by either internal or surface sizing procedures. Rosin size and synthetic resins are the two principal materials used for the internal sizing of paper. Other materials may be used only in small quantities. Nevertheless, rosin size remains, by far, the most important internal sizing agent for bleached board products, while for fine paper products, particularly free sheet, synthetic resins are preferred, primarily due to the use of precipitated calcium carbonate in such products.

The difficulties involved in the sizing of calcium carbonate filled papers with the use of common sizing ingredients such as rosin and alum have been long recognized.

U.S. Pat. No. 2,114,509 teaches a method for producing sized paper including a filler containing a calcium salt and an acidic precipitant wherein the mixture of furnish and sizing components is maintained out of contact with the outside atmosphere. Under these conditions, the escape from the mixture of substantial quantities of carbon dioxide is prevented. The method is disclosed as being capable of achieving good sizing while substantially eliminating foam. The benefit of carbon dioxide as a sizing enhancer was recognized in U.S. Pat. No. 5,378,322, where the patentee dissolved $CO_2$ in an aqueous vehicle to catalyze the reaction between the alkylketene dimer sizing agent and the cellulose in the paper-making fibers. Also, U.S. Pat. No. 2,195,600 discloses the use of a protective colloid for rosin in a papermaking furnish containing alkaline filler, to protect the rosin prior to being precipitated by alum. The present invention, as herein disclosed, provides a more effective sizing method for high hardness conditions, and is distinguished by the aforesaid prior art, by producing a size material by pre-reacting alum and liquid rosin size before the mixture is introduced into the papermaking furnish.

In rosin or soap rosin sizing, papermaking fibers are rendered hydrophobic by precipitating the rosin with alum to produce aluminum rosinate (see article entitled "Chemistry of Rosin Sizing," by Edward Strazdins, TAPPI magazine, January 1981, vol. 64, No. 1, pp. 31–34). As Strazdins pointed out, the rosin-alum sizing system is useful for various practical reasons, including the following:

(a) the aluminum rosinate precipitate is an excellent retention aid,
(b) the degree of sizing is easy to control,
(c) the handling of rosin size is relatively simple,
(d) the problems of repulping waste are minimal,
(e) the size is compatible with other wet-end additives, and
(f) the costs of sizing with rosin are relatively low.

A significant drawback to the use of rosin or soap rosin size, however, is the reduction of paper strength due to the strong attachment of the aluminum rosinate precipitate to papermaking fibers. Because of this, the size precipitate is not capable of relocating during the web consolidation and interferes with fiber bonding. The efficiency of alum-rosin sizing suffers even more if the papermaking furnish has a high hardness, or contains large amounts of calcium or magnesium ions. The presence of calcium, for example, produces calcium rosinate, which is an inferior sizing agent to aluminum rosinate and, thus, reduces sizing efficiency.

A currently employed method for offsetting the negative effect of high hardness on sizing is to use reverse sizing. With this technique, the alum is added to the furnish before the rosin size. Thus, reverse sizing represents an improvement over conventional rosin sizing of high hardness furnish, since the alum is already in the furnish when the rosin size is added. While reverse sizing can lead to some sizing improvement in a high hardness furnish, the alum must still compete with any multivalent cations in the furnish. Accordingly, the present invention is directed to a rosin size material that achieves even further improvement in the sizing of high hardness furnishes, using either standard or reverse sizing methods, than can be achieved even with reverse sizing with conventional rosin size.

It is, therefore, an object of the present invention to provide an alum-rosin size composition to achieve maximum effectiveness even under high hardness conditions. It is a further object of the present invention, and a benefit to use of the novel invention size material, to improve the efficiency of alum-rosin sizing systems in high hardness furnishes in order to optimize the amount of size needed to achieve the desired level of sizing.

SUMMARY OF THE INVENTION

The above objects are achieved by the present invention rosin size for use as an internal size to produce a papermaking furnish having high hardness than has heretofore been possible. Either by using conventional sizing methods which employ alum and rosin or by adopting reverse sizing, the alum must still compete for reaction with any multivalent cations in the high hardness furnish. However, an improved sizing agent is produced by pre-reacting either neat or solutions of alum and liquid rosin size before introducing the mixture into the papermaking furnish, the alum is free to react with the rosin size without any competition from other cations.

DESCRIPTION OF THE PREFERRED EMBODIMENT(S)

Figure 1:
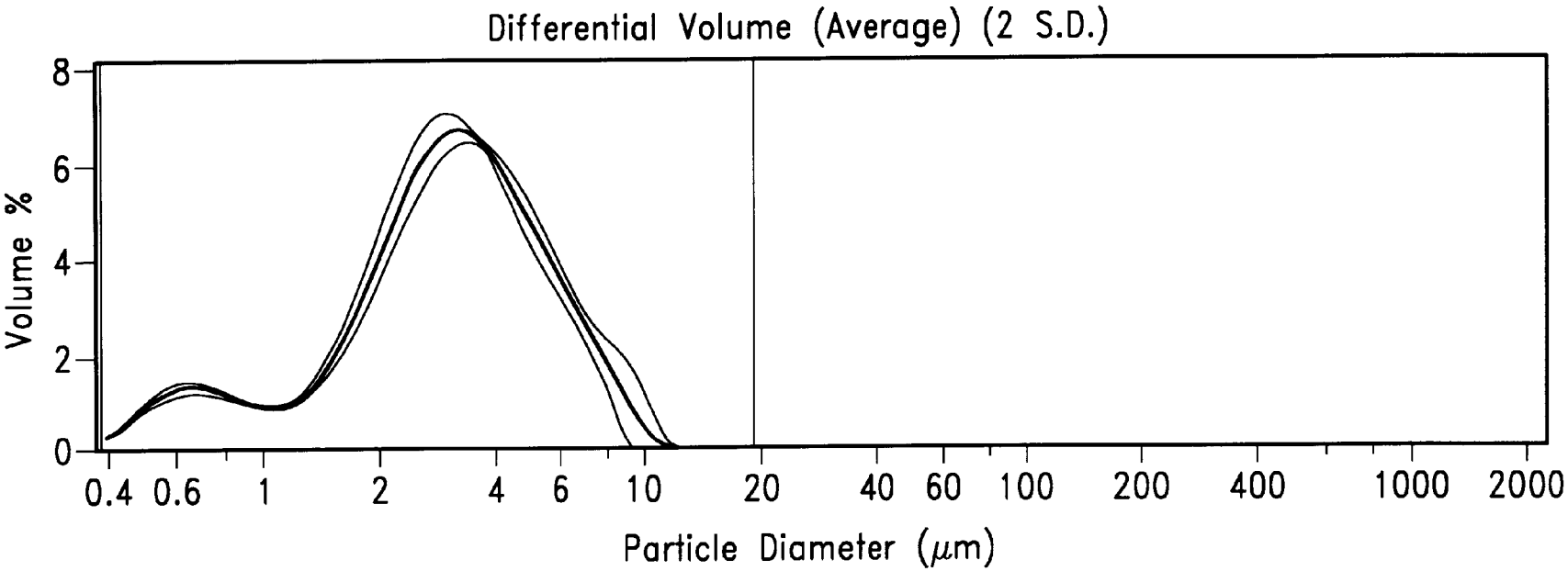
FIG. 1 is a graphic representation of the particle size distribution of a sample of the invention composition.
Figure 2:
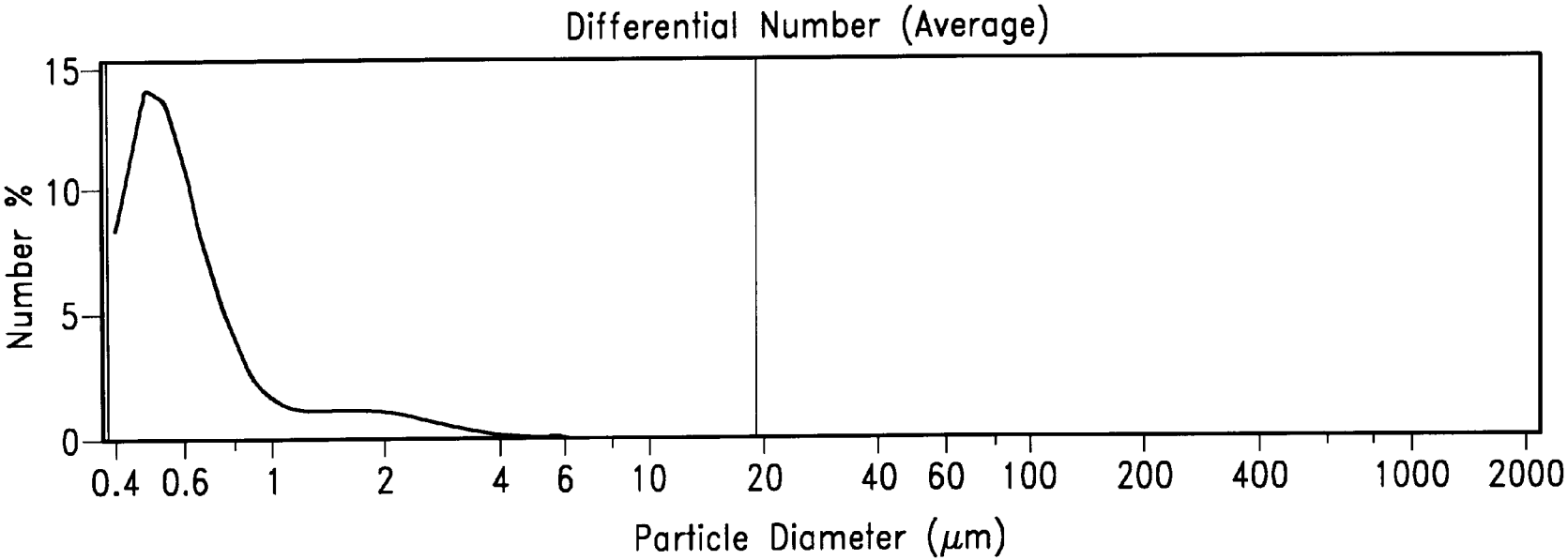
FIG. 2 is a graphic representation of the particle size distribution of a sample of the invention composition.

It is known that the presence of calcium cations in a papermaking furnish will lower the sizing efficiency of a rosin or soap rosin sizing system. The divalent calcium cations compete with the trivalent aluminum cations from the alum to complex with the rosin. Calcium rosinate is not retained in the web as efficiently as aluminum rosinate, and sizing is lost. This competition is a particular problem when rosin or soap rosin size is added to the papermaking furnish before the alum, as in conventional sizing, and interacts with any multivalent cations present in the system.

It is also well known that the sizing problems described above can be overcome to some extent by using a reverse sizing technique. In reverse sizing the alum is added to the furnish before the rosin size. Thus, reverse sizing presents an improvement over conventional alum-rosin sizing, since the alum is in the furnish when the rosin size is added.

In accordance with the present invention, however, an even further improvement in sizing has been discovered by pre-reacting alum, either neat or in solution, and liquid soap rosin size before the mixture is added to the papermaking furnish. Using the pre-reaction technique, the alum is free to react with the rosin size without any competition from other cations in the system. It has been discovered that an added effect of this pre-reaction technique, when conducted in a highly kinetic environment, is the production of rosin size material of a beneficial particle size.

EXAMPLE 1

The initial study in this work involved a comparison of the sizing efficiency of three different sizing techniques. These tests are standard techniques used in the industry by those skilled in the art.

(1) Conventional sizing—add rosin, then add alum to the papermaking furnish.

(2) Reverse sizing—add alum, then add rosin to the papermaking furnish.

(3) Premixing—add rosin to alum, then add the mixture to the papermaking furnish. Comparisons were made at 77° F. with a typical papermaking furnish having a hardness factor of 750 ppm. The data in Table 1 indicate that pre-reacting the alum and rosin produced a significant increase in sizing compared with both the conventional and reverse sizing methods, as determined by three tests: HST, Water Cobb, and Triton Cobb.

TABLE I

| Method | HST (sec) | Water Cobb $g/m^2$ | Triton Cobb $g/m^2$ |
|---|---|---|---|
| Conventional sizing | 16 | 166 | 197 |
| Reverse sizing | 23 | 150 | 203 |
| Premixing | 49 | 77 | 151 |

For each of the methods used, the papermaking furnish consisted of a blend of 10% pine, 40% hardwood, 50% broke, and cationic starch at 12 lb/ton. The handsheets tested had a basis weight of about 84 lbs/ream (ream size of 3000 sq. ft). For each condition, the sizing system comprised a 1.0% solution of STAFOR 50 rosin size (a product of Westvaco Corporation) and alum at an alum to rosin ratio of about 3 to 1.

As can be seen from the data in Table I, the premixing method produced the lowest sizing value, as determined by the Water Cobb and Triton Cobb tests, and the highest sizing value, as determined by the UST test. It should be noted that for the Cobb tests the lower numbers represent better sizing; whereas, for the HST test, higher numbers represent better sizing.

EXAMPLE 2

A second study was conducted to examine the effect of solution concentration on sizing efficiency for the pre-reaction of alum and rosin according to the present invention. Two different conditions were examined, at temperatures of 77° F. and 122° F. The results are shown in Table II.

TABLE II

| Temperature (° F.) | Concentration (%) | HST (sec) | Water Cobb ($g/m^2$) | Triton Cobb ($g/m^2$) |
|---|---|---|---|---|
| 77 | 0.1 | 173 | 38 | 72 |
| 77 | 1.0 | 49 | 77 | 151 |
| 77 | 10.0 | 13 | 144 | 202 |
| 122 | 0.1 | 112 | 42 | 95 |
| 122 | 1.0 | 32 | 132 | 184 |
| 122 | 10.0 | 13 | 150 | 189 |

The data in Table II illustrate a preferential sizing treatment at the lowest solution concentration for each temperature condition. Specifically, the data show that internal sizing, as measured by HST, Water Cobb, and Triton Cobb tests at a concentration of 0.1%, was significantly better than that of the intermediate and higher concentrations. For example, as the cocentration of the pre-reacted alum and size mixture was increased from 0.1% to 10%, internal sizing as measured by HST decreased from 173 seconds to 13 seconds.

EXAMPLE 3

Another study was conducted to determine the optimum alum to rosin ratio for the pre-reaction process of the present invention. When using conventional sizing techniques, it was standard practice to add excess alum to the papermaking furnish to achieve complete precipitation of the rosin size. As an example, it was common to add alum in a 2.5 to 1 or greater ratio at the wet end of the paper machine. The invention alum/rosin sizing composition may be added in a ratio of 1–3:1. However, as shown by the data in Table III below, by pre-reacting the alum and rosin according to the present invention, the optimal ratio of alum to rosin was found to be about 1.5 to 1, according to the Triton Cobb test.

TABLE III

| Alum/Rosin (ratio) | Triton Cobb ($g/m^2$) |
|---|---|
| 1:1 | 72 |
| 1.5:1 | 56 |
| 2:1 | 82 |
| 2.5:1 | 107 |

The data in Table III was generated from handsheets having a basis weight of 151 lbs/ream (ream size of 3000 $ft^2$), prepared from a furnish having a hardness factor of 500 ppm at a pH of 4.2 and ambient temperature (about 70° F.).

EXAMPLE 4

A further experiment was conducted to find the minimum hardness level at which the benefits of the present invention could be observed. In this experiment, handsheets were manufactured from a pulp blend consisting of 10% pine and 90% hardwood at a basis weight of 84 lbs/ream (ream size of 3000 ft.). The sizing system comprised an alum to rosin ratio of about 3 to 1 at a concentration of about 1%. Cationic starch, in an amount of 12 lbs/ton, was also added to the furnish. The hardness was varied from 0 to 750 ppm with the addition of calcium carbonate. The results are shown in Table IV.

TABLE IV

| Hardness ($Ca^{++}$) (ppm) | Reverse Sizing Triton Cobb ($g/m^2$) | Premixing Triton Cobb ($g/m^2$) |
|---|---|---|
| 0 | 66 | 60 |
| 75 | 79 | 57 |
| 225 | 101 | 67 |
| 450 | 136 | 109 |
| 750 | 167 | 100 |

As shown by the data in Table IV, premixing according to the present invention and standard reverse sizing were found to produce substantially the same sizing values in a furnish with 0 ppm hardness. However, at a hardness level of 75 ppm, reverse sizing according to the Triton Cobb test increased to a value of 79 $g/m^2$ while the sizing achieved by premixing remained substantially the same at 57 $g/m^2$. Thus, improved efficiency in sizing was observed beginning at a hardness level as low as 75 ppm, and this improvement continued up to the highest hardness level tested (750 ppm). It is believed that these results should be the same for furnishes having even higher hardness factors, and the results are believed to demonstrate the utility of the present invention in producing increased sizing efficiency in furnishes have a high hardness factor.

EXAMPLE 5

Figure 3:
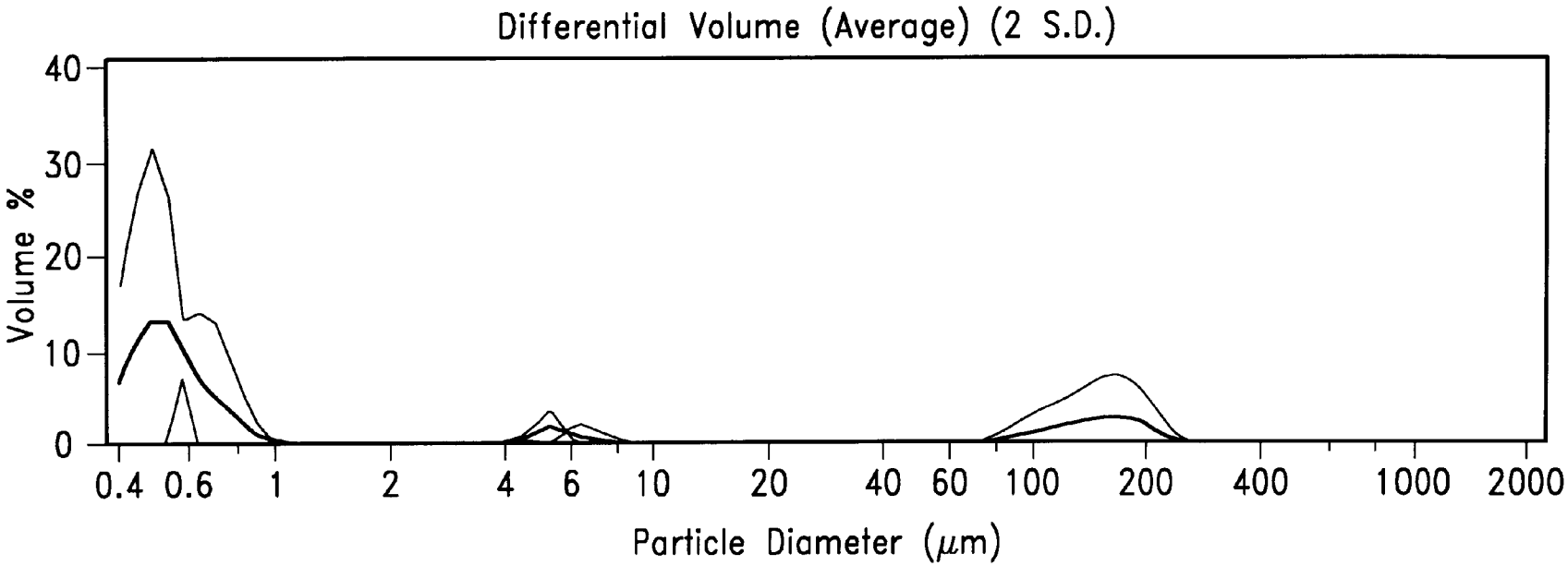
FIG. 3 is a graphic representation of the particle size distribution of a sample of a prior art composition.

A final study was conducted to measure the particle size of the pre-mixed alum/rosin composition. Scanning electron microscope photographs showed individual particle diameters in the range of about 0.1 to about 20 microns, with a mean particle diameter of less than 10. Two samples of the invention composition were analyzed for particle size using a Coulter LS Particle Size Analyzer. FIGS. 1 (sample #1) and 2 (sample #2) graphically depict the particle size distributions. For comparison purposes, the mean particle size of a standard, commercial pre-mix cationic rosin size used for the manufacture of paper from Georgia Pacific, sold under the mark "NOVAPLUS®," was similarly determined. FIG. 3 graphically depicts the particle size distribution for the prior art NOVAPLUS. Table V shows the average particle size diameters for up to less than 90% of each sample, as well as the calculated mean and median particle sizes for each sample.

TABLE V

| Sample # | <10% μm | <25% μm | <50% μm | <75% μm | <90% μm | mean μm | median μm |
|---|---|---|---|---|---|---|---|
| 1 | 0.976 | 2.007 | 3.009 | 4.383 | 6.063 | 3.342 | 3.009 |
| 2 | 0.418 | 0.466 | 0.555 | 0.711 | 1.201 | 0.729 | 0.555 |
| 3 | 0.426 | 0.481 | 0.585 | 5.642 | 152.6 | 32.19 | 0.585 |

The mean particle size of the NOVAPLUS composition sample (sample #3) was determined to be 32.19 microns, compared with no greater than 3.342 microns for the invention composition. It is theorized that the improved sizing efficiency achieved as shown in Example 4 is not only a result of the alum/rosin ratio but also is a result of the significantly smaller particle size (a mean particle size of ≦10 microns) of the invention size composition. A preferred mean particle size diameter range is from about 0.1 microns to about 5 microns and, more preferably, from about 0.5 microns to about 3.0 microns.

The invention rosin size product for papermaking is pre-reacted for use in papermaking by injecting into a stream of water directed to a multiple of mixing chambers, in either order, a flow of rosin and a flow of alum for pre-reacting.

Figure 4:
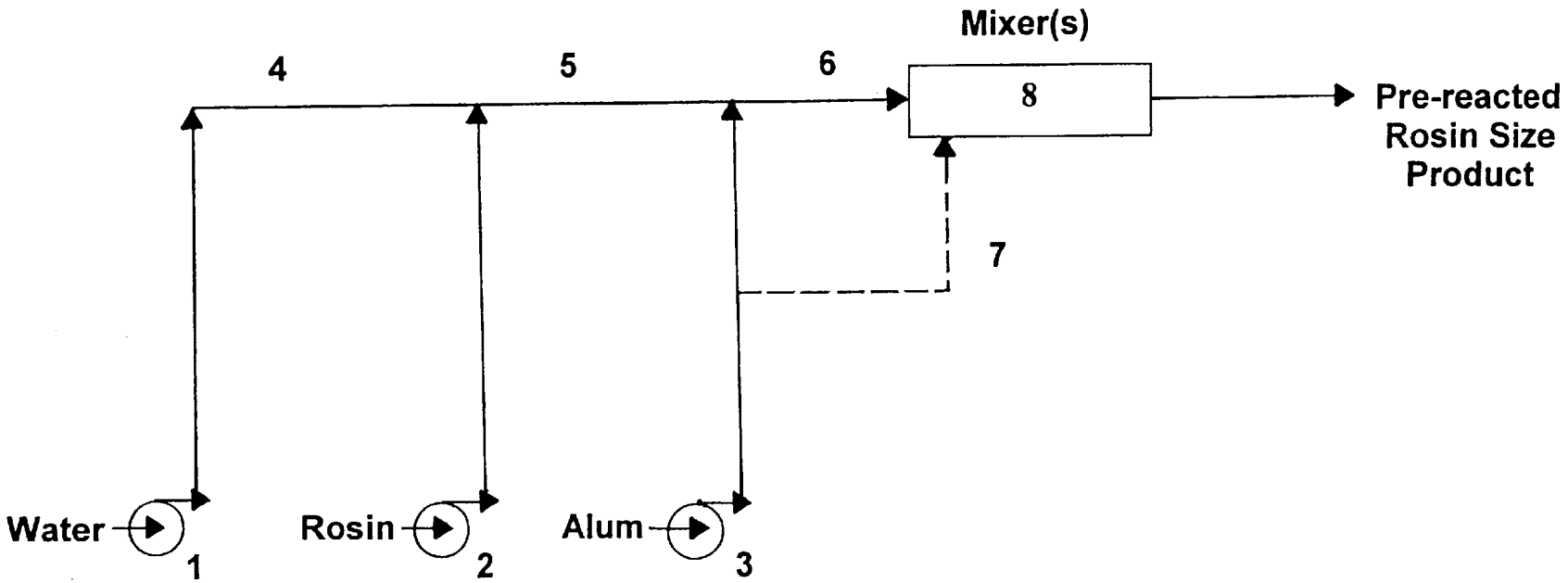
FIG. 4 is a graphic representation of one method for achieving the invention near particle size.

One method for achieving the invention mean particle size is shown in FIG. 4, depicting the following steps:

(1) Water is pumped by a pump 1 from a source of said water to create a water stream 4 directed to a series of mixers or mixing chambers 8;

(2) Rosin, preferably in the form of liquid rosin soap, is pumped by a pump 2 from a source of said rosin and injected into water stream 4 to create a water/rosin stream 5;

(3) Alum is pumped by a pump 3 from a source of said alum and injected into water/rosin stream 5 to create a water/rosin/alum stream 6; and (4) Water/rosin/alum stream 6 enters mixers or mixing chambers 8 wherein the rosin and alum react under highly kinetic conditions to form a pre-reacted rosin size product for use in papermaking, which product is ejected from mixer or mixing chambers 8.

In an alternative embodiment of the above-described method, the injection point of the alum may be directly into the mixers or mixing chambers 8, via alum stream 7.

In an alternative embodiment of the above-described methods, the injection order of rosin and alum may be reversed.

The mixers or mixing chambers 8 may be selected from the group of ultrasonic mixers, homogenizers, turbines, rotor/stator configurations, both with recycle or without recycle, a mixture thereof, and one or more of these in series.

The process of the present invention may conveniently be arranged so as to interface with the normal processing of the papermaking furnish at the wet end of the paper machine. For the purpose of the present invention, a high hardness furnish is defined as one where the hardness factor is at least about 75 ppm, and preferably between about 75 and 750 ppm or higher. In the practice of the present invention, the alum to rosin ratio may vary from equal parts alum and rosin to as high as 3 parts alum to 1 part rosin, and preferably from about 1.5 parts alum to 1 part rosin. The solution concentration after mixing may range from about 0.05–10%, and preferably is about 0.1% for low pH furnishes. These ratios and preferred ranges may vary, depending upon the type of furnish and furnish pH.

That which the inventors consider to be the subject matter of this invention is:

(1) A composition of matter for internally sizing paper comprising particles of an alum/rosin blended material characterized by a mean particle size of no greater than 10 microns and an alum to rosin ratio of about 1–3: 1, respectively;

(2) the composition of (1) wherein the ratio of alum to rosin is from about 1 part alum to about 1 part rosin and the composition mean particle size is from about 0.1 to 5.0 microns; and (3) the composition of (2) wherein the alum/rosin ratio is from about 1.5 parts alum to about 1 part rosin and the mean particle size is from about 0.5 microns to about 3.0 microns; as well as (4) An aqueous solution of the composition of (1) characterized by a solution concentration of from about 0.05 % to about 10% solids; and (5) the aqueous solution of (4) characterized by a solution concentration of about 0. 1% solids.

(6) A method for preparing the composition of claim 1 according to the steps of:

(a) directing water from a source of said water to create a water stream directed to a series of mixers;

(b) injecting rosin, preferably in the form of liquid rosin soap, into the water stream to create a water/rosin stream;

(c) injecting alum into the water/rosin stream to create a water/rosin/alum stream; and (d) directing the water/rosin/alum stream into the series of mixers wherein the rosin and alum react under highly kinetic.

(7) the method of (6) wherein the alum may be injected directly into the series of mixers.

(8) the method of (6) wherein the order of rosin and alum injection may be reversed.

(9) the method of (7) wherein the order of rosin and alum injection may be reversed.

(10) the method of (6) wherein the series of mixers is selected from the group of ultrasonic mixers, homogenizers, turbines, rotor/stator configurations, both with recycle or without recycle, and a combination thereof.

While the preferred method for carrying out the process of the present invention has been described herein in some detail, it will be understood that numerous variations may be made in carrying out the process, and in the construction and arrangement of equipment for carrying out the process, without departing from the general spirit and scope of the invention. Accordingly, the breadth of the present invention should only be limited by the scope and content of the appended claims.

What is claimed is:

1. A composition of matter for internally sizing paper comprising particles of an alum/liquid rosin soap blended material characterized by a mean particle size of no greater than 10 microns and an alum to rosin ratio of about 1–3:1, respectively.

2. The composition of claim 1 wherein the alum/liquid rosin soap ratio is about 1 part alum to about 1 part rosin and the mean particle size is from about 0.1 microns to about 5.0 microns.

3. The composition of claim 2 wherein the alum/liquid rosin soap ratio is from about 1.5 parts alum to about 1 part rosin and the mean particle size is from about 0.5 microns to about 3.0 microns.

4. An aqueous solution of the composition of claim 1 characterized by a solution concentration of from about 0.05% to about 10% solids.

5. The aqueous solution of claim 4 characterized by a solution concentration of about 0.1% solids.

6. A method for preparing the composition of claim 1 according to the steps of:

(a) directing water from a source of said water to create a water stream directed to a series of mixers;

(b) injecting liquid rosin soap, into the water stream to create a water/rosin stream;

(c) injecting alum into the water/rosin stream to create a water/rosin/alum stream, wherein the alum/rosin is from about 1.5 parts alum to about 1 part rosin; and (d) directing the water/rosin/alum stream into the series of mixers wherein the rosin and alum react under highly kinetic conditions.

7. The method of claim 6 wherein the alum may be injected directly into the series of mixers.

8. The method of claim 6 wherein the order of rosin and alum injection may be reversed.

9. The method of claim 7 wherein the order of rosin and alum injection may be reversed.

10. The method of claim 6 wherein the series of mixers is selected from the group of ultrasonic mixers, homogenizers, turbines, rotor/stator configurations, both with recycle or without recycle, and a combination thereof.

11. The method of claim 6 wherein the liquid rosin soap is derived from potassium rosinate.

12. The method of claim 11 wherein the alum/rosin ratio is from about 1 part alum to about 1 part rosin.

13. The product of the method of claim 6.

14. The product of the method of claim 8.

15. The product of the method of claim 9.

* * * * *